US009381411B2

(12) United States Patent
Higdon et al.

(10) Patent No.: US 9,381,411 B2
(45) Date of Patent: Jul. 5, 2016

(54) TOP LOADING HEADCOVERS AND METHODS TO MANUFACTURE TOP LOADING HEADCOVERS

(71) Applicant: Karsten Manufacturing Corporation, Phoenix, AZ (US)

(72) Inventors: David A. Higdon, Phoenix, AZ (US); James D. Martell, Phoenix, AZ (US); Ryan J. Bruce, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 103 days.

(21) Appl. No.: 13/967,928

(22) Filed: Aug. 15, 2013

(65) Prior Publication Data

US 2015/0047761 A1 Feb. 19, 2015

(51) Int. Cl.
*A63B 57/00* (2015.01)
*A63B 55/00* (2015.01)

(52) U.S. Cl.
CPC ..... *A63B 55/007* (2013.01); *A63B 60/62* (2015.10); *A63B 2209/00* (2013.01); *Y10T 29/49826* (2015.01)

(58) Field of Classification Search
CPC . A63B 55/007; A63B 60/62; Y10T 29/49826
USPC ..... 150/160; 29/428
See application file for complete search history.

(56) References Cited

U.S. PATENT DOCUMENTS

| | | | | |
|---|---|---|---|---|
| 2,128,546 | A * | 8/1938 | Venmore | 211/70.2 |
| 3,117,609 | A * | 1/1964 | Pio | 150/160 |
| 3,664,399 | A | 5/1972 | Neff | |
| 4,195,677 | A | 4/1980 | Hagg et al. | |
| 4,378,832 | A * | 4/1983 | Thompson | 150/160 |
| 5,000,238 | A | 3/1991 | Zeller | |
| 5,004,239 | A * | 4/1991 | Wettstein | 473/282 |
| 5,779,042 | A | 7/1998 | Kaneko | |
| 6,298,987 | B1 | 10/2001 | Clark | |
| 7,584,844 | B2 | 9/2009 | Kvinge et al. | |
| D603,473 | S | 11/2009 | Templeton | |
| 7,721,884 | B2 | 5/2010 | Kvinge et al. | |
| 2003/0075252 | A1 | 4/2003 | Noyes | |
| 2003/0121808 | A1 * | 7/2003 | Maeng | 206/315.2 |
| 2008/0230159 | A1 | 9/2008 | Tan | |
| 2008/0264534 | A1 | 10/2008 | Carey | |
| 2009/0133790 | A1 * | 5/2009 | Maeng et al. | 150/160 |

FOREIGN PATENT DOCUMENTS

GB 2404595 A * 2/2005

OTHER PUBLICATIONS

English Abstract only of Japanese Application No. 2001-137406, one page.

* cited by examiner

*Primary Examiner* — Sue A Weaver

(57) ABSTRACT

Embodiments of top loading headcovers and methods to manufacture top loading headcovers are generally described herein. Other embodiments of top loading headcovers may be described and claimed.

17 Claims, 18 Drawing Sheets

TOP LOADING HEADCOVERS AND METHODS TO MANUFACTURE TOP LOADING HEADCOVERS

FIELD

The present document generally relates to headcovers for golf clubs, and in particular to top loading headcovers having a biased top shroud that covers an opening that allows for the insertion of a golf club through the top portion of the headcover.

BACKGROUND

Golf headcovers are used to store and protect a club head when the golf club is not being used. In addition, golf headcovers may be made of a fabric material configured to receive the club head therein which requires an individual to work the larger club head through the smaller opening formed at the lower portion of the headcover. As such, this smaller opening of the golf headcover must be repeatedly stretched by an individual to accommodate passage of the larger club head through the smaller opening each time the club head is stored inside the interior portion of the headcover body. Unfortunately, repeated insertion of the club head into the golf headcover over time can stretch the material of the headcover body so that the golf headcover assumes a stretched condition and worn appearance. Although other types of golf headcovers allow for insertion of the golf club through a covered opening formed along the top portion of the golf headcover, this type of arrangement requires an expensive mechanical hinge to cover and uncover the opening. As such, the mechanical hinge can become worn after repeated use, thereby causing the mechanical hinge to become worn and/or inoperative.

BRIEF DESCRIPTION OF THE DRAWINGS

Corresponding reference characters indicate corresponding elements among the view of the drawings. The headings used in the figures do not limit the scope of the claims.

DESCRIPTION

Figure 6:
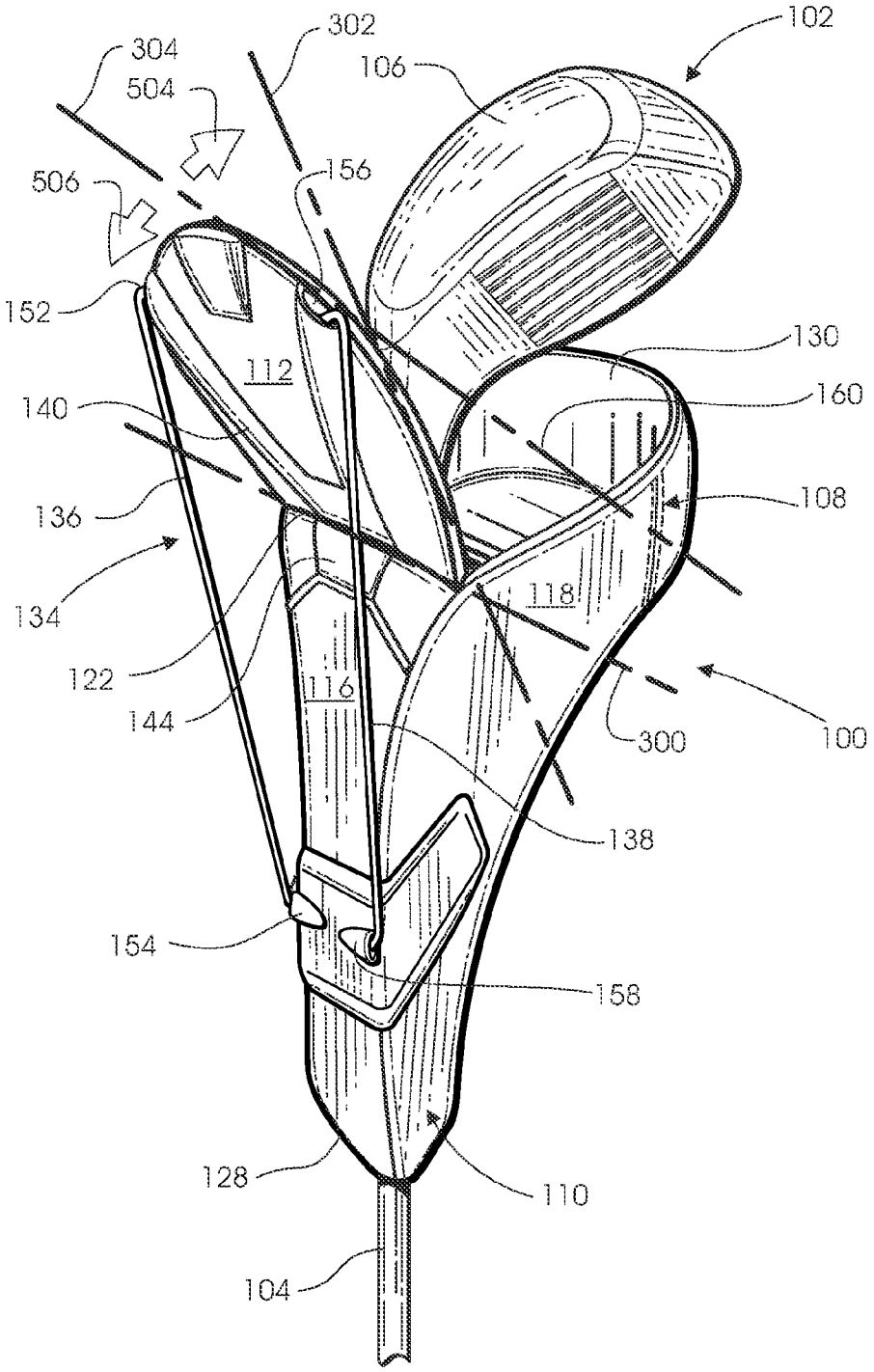
FIG. 6 is perspective view of the top loading headcover of FIG. 1 shown in the open position.

Top loading headcovers and methods of manufacturing top loading headcovers having a biased top shroud that covers an upper opening to allow insertion of a golf club through the upper portion of the headcover are described herein. Referring to the drawings, embodiments of top loading headcovers are illustrated and generally indicated as 100 and 200 in FIGS. 1-18. As shown in FIGS. 1-5, one embodiment of the top loading headcover, designated 100, may include a headcover body 101 having a belly panel 114, a back panel 116, a first side panel 120 and a second side panel 118 that collectively define a lower portion 110 forming a proximal opening 128 and an upper portion 108 forming a distal opening 130 (FIG. 6). Referring to FIG. 6, the proximal opening 128 and the distal opening 130 directly communicate with an interior portion 160 of the headcover 100 that is configured to receive a club head 106 and a portion of a club shaft 104 of a golf club 102. In addition, as shown in FIGS. 1 and 3-6, a top shroud 112 is connected to the back panel 116 through a hinge point 122 that allows the top shroud 112 to be rotated along an axis 300 (FIGS. 3 and 6) between a closed position when the top shroud 112 contacts the upper portion 108 of the headcover body 101 for closing off the distal opening 130 and an open position when the top shroud 112 no longer contacts the upper portion 108 of the headcover body 101 for opening up the distal opening 130. In some embodiments, the hinge point 122 may define a dividing line between the top shroud 112 and the back panel 116 that is configured to permit rotation of the top shroud 112 relative to the back panel 116.

Figure 1:
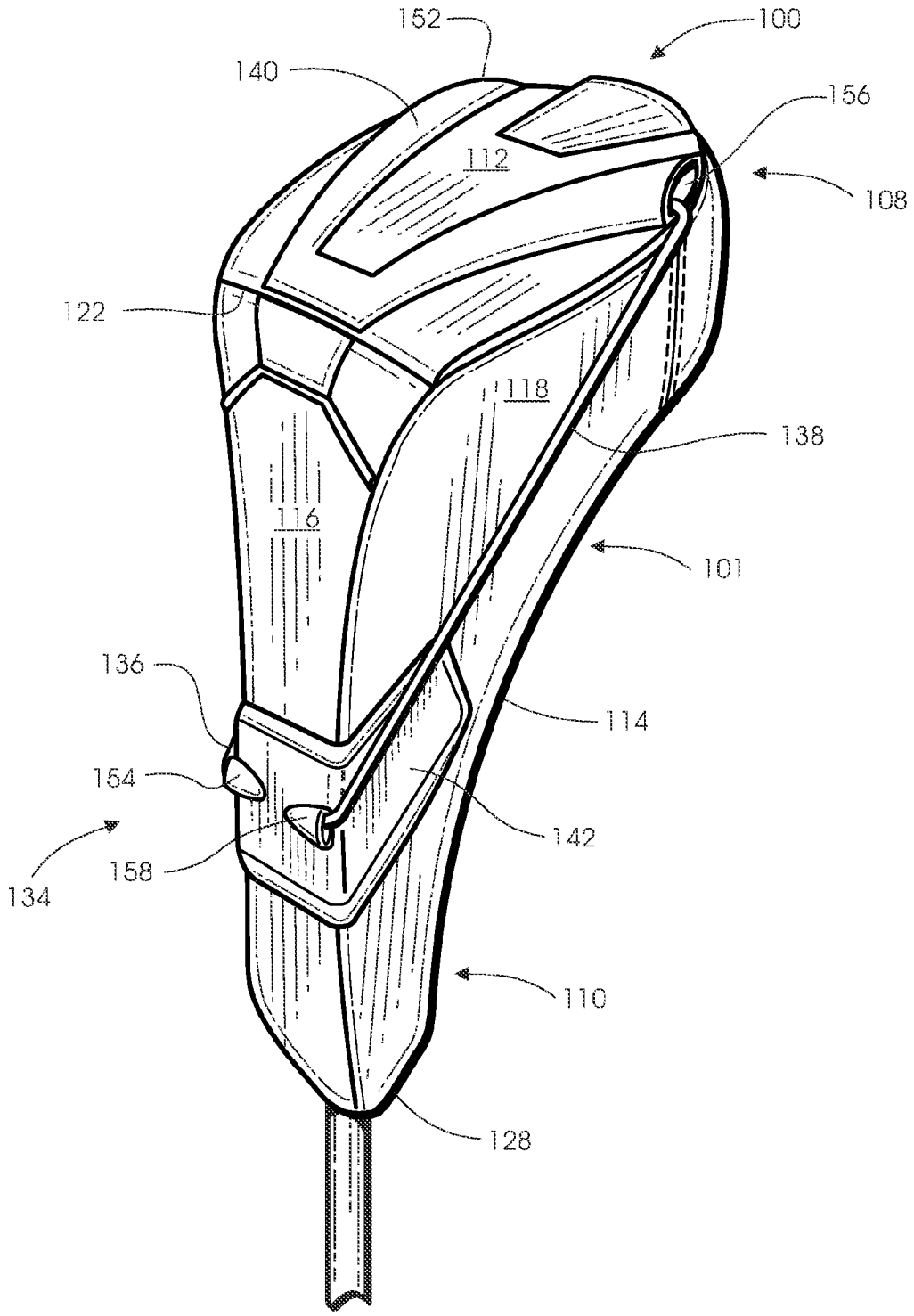
FIG. 1 is perspective view of a first embodiment of a top loading headcover shown in the closed position.
Figure 2:
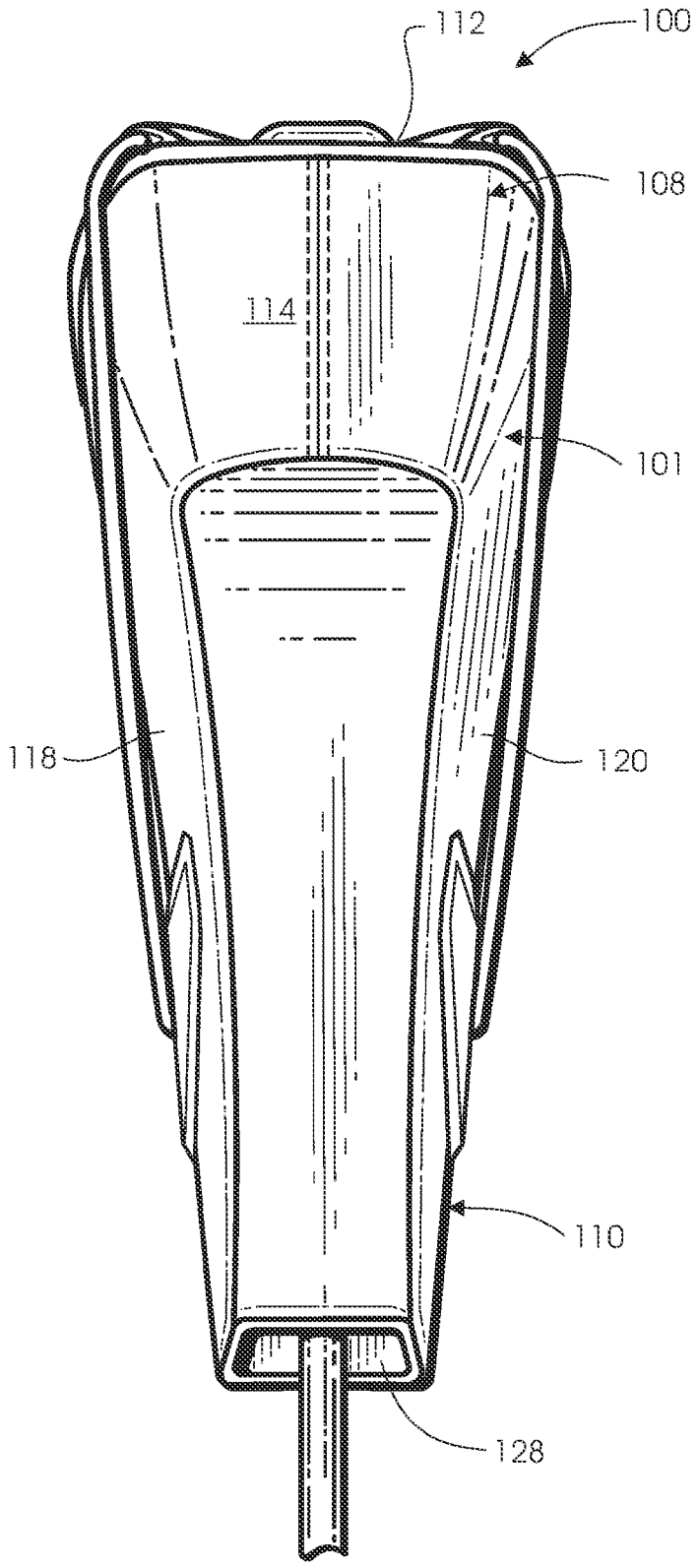
FIG. 2 is a front view of the top loading headcover of FIG. 1.
Figure 3:
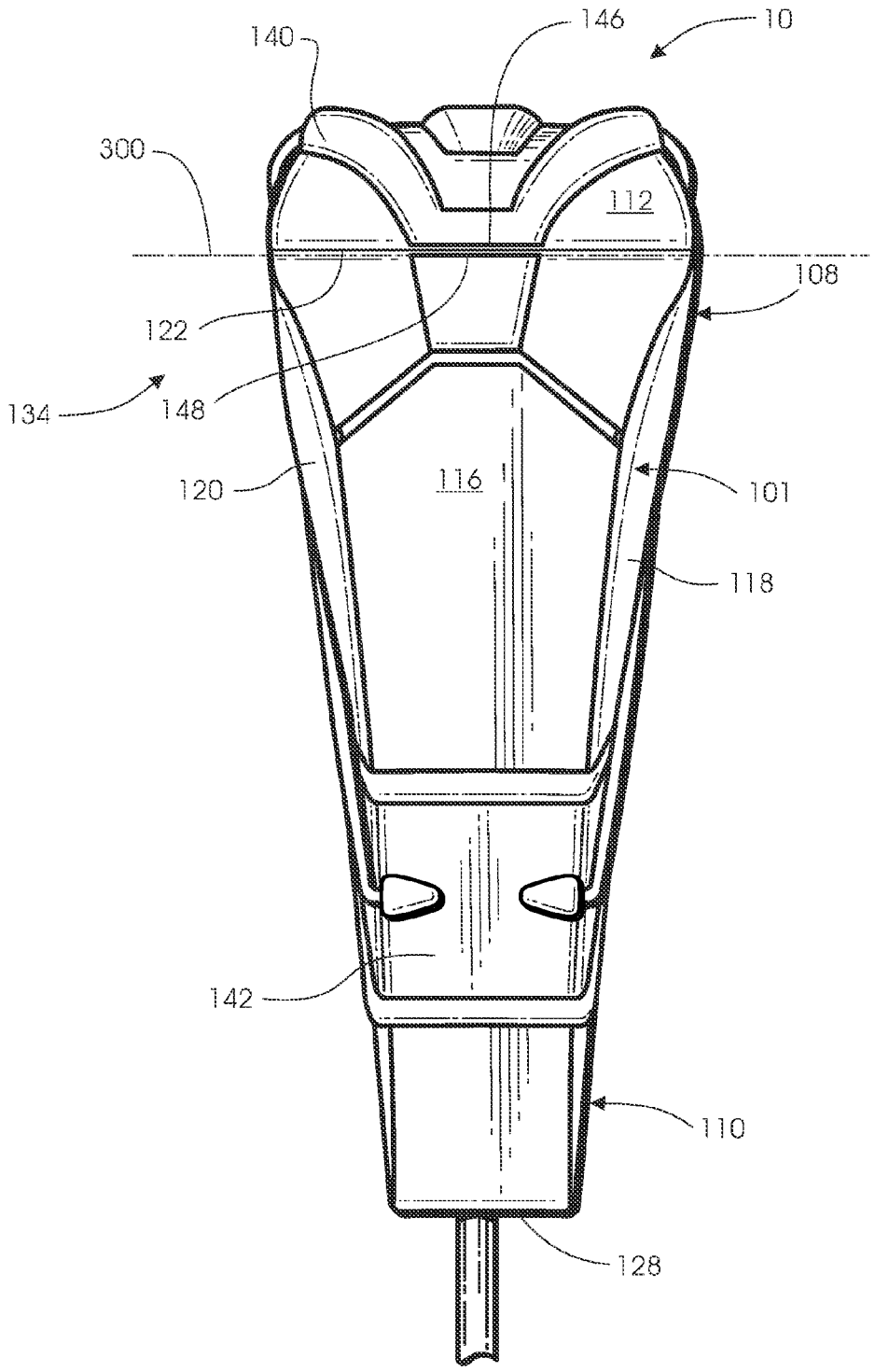
FIG. 3 is a rear view of the top loading headcover of FIG. 1.

As further shown in FIG. 6, when the top shroud 112 is placed in the open position by an individual a biasing mechanism 134 engaged to the headcover body 101 biases the top shroud 112 into the open position and maintains the top shroud 112 in the open position until the individual physically rotates the top shroud 112 back into the closed position. Referring to FIGS. 1 and 6, in one embodiment, the biasing mechanism 134 may include a first elastic member 136 that is connected to the top shroud 112 at a first anchor point 152 and the back panel 116 at a second anchor point 154. Similarly, a second elastic member 138 may be connected to the top shroud 112 at a third anchor point 156 and the back panel 116 at a fourth anchor point 158. In some embodiments, the first, second, third and fourth anchor points 152, 154, 156 and 158 may be securing points configured to receive and engage the first and second elastic members 136 and 138, respectively, to the top shroud 112 and back panel 116, respectively. In one arrangement shown in FIGS. 4 and 5, the first elastic member 136 extends along the first side panel 120 between the top shroud 112 and the back panel 116, while the second elastic member 138 extends along the second side panel 118 between the top shroud 112 and the back panel 116 when the top shroud 112 is in the closed position. Referring back to FIG. 1 in some embodiments, the top shroud 112 may include a first molded member 140 that is configured to engage the first and second elastic members 136 and 138, respectively, at first and third anchor points 152 and 156, while the back panel 116 may include a second molded member 142 configured to engage the opposite ends of the first and second elastic member 136 and 138, respectively, at the second and fourth anchor points 154 and 158, respectively. In some embodiments, the first and second elastic members 136 and 138 may be a bungee cord that applies a spring force when stretched; however, other types of elastic members may be used, such as a wire, an elastic synthetic or organic material, and/or spring that generate a spring force when a bias is applied.

Figures 4, 19:
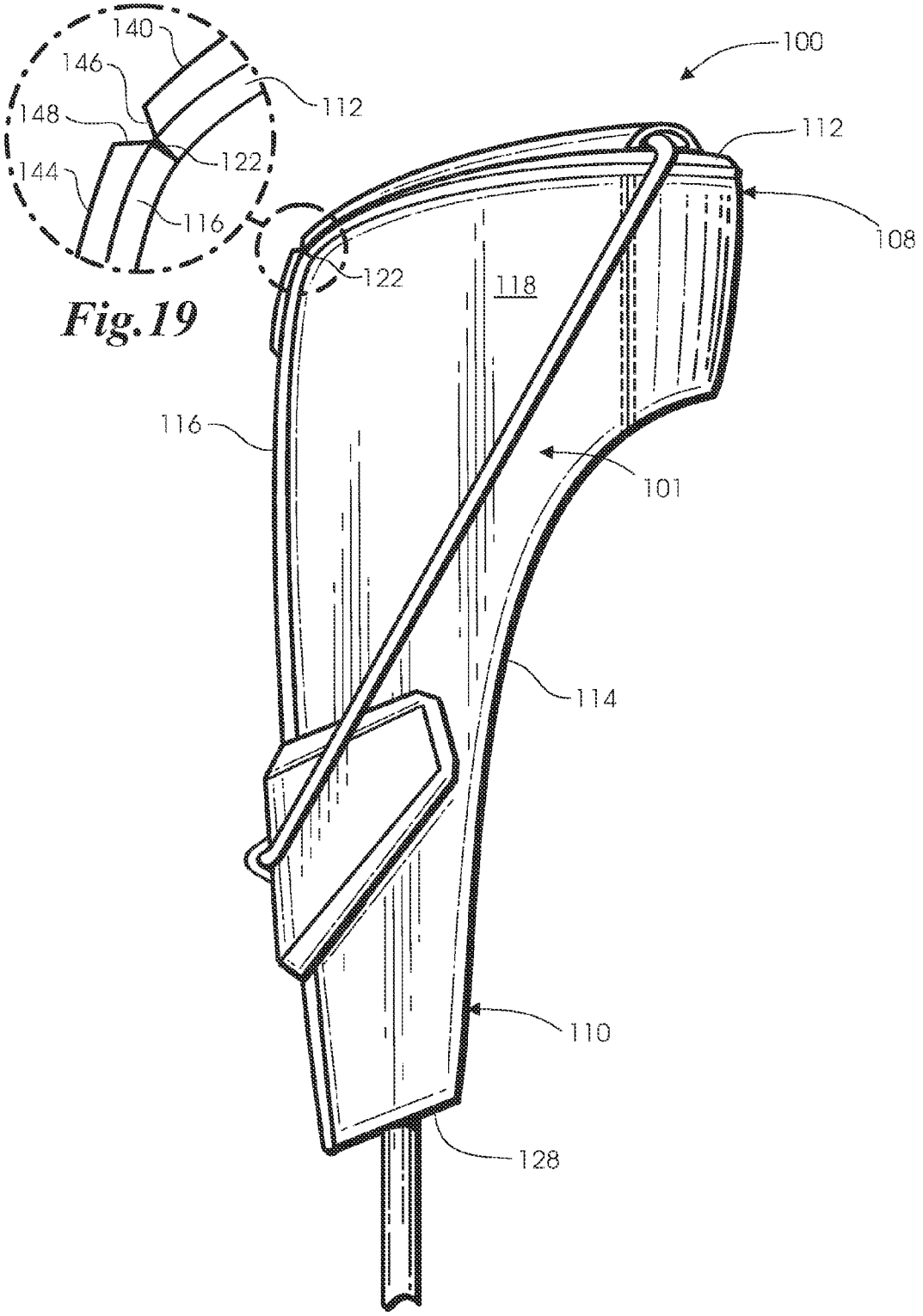
FIG. 4 is a side view of the top loading headcover of FIG. 1.
FIG. 19 is an enlarged view of the first and second stop members shown in FIG. 4.
Figure 5:
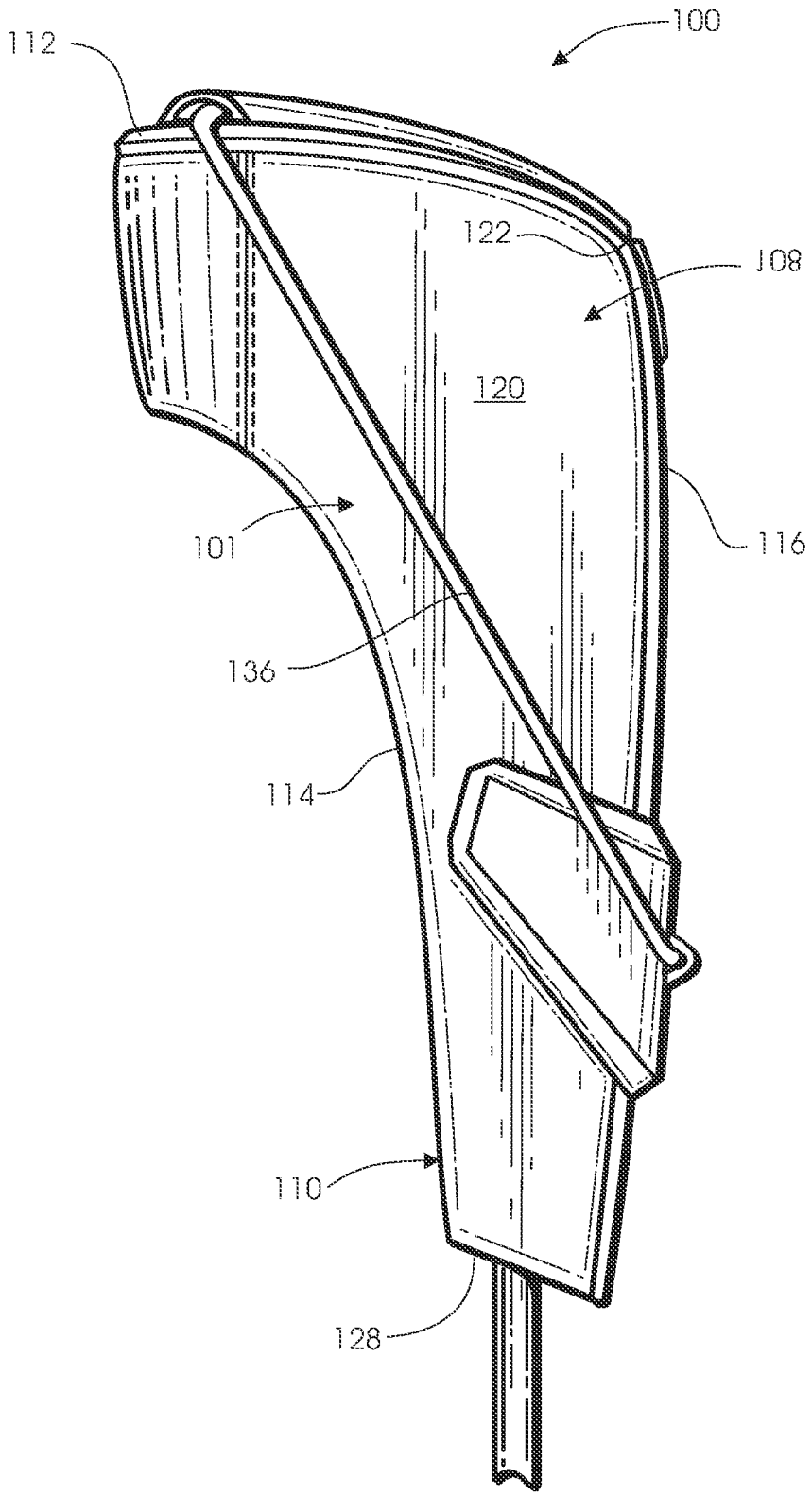
FIG. 5 is an opposite side view of the top loading headcover of FIG. 1.

Referring back to FIG. 3 the biasing mechanism 134 further includes a first stop portion 146 and a second stop portion 148 for providing a means of preventing further rotation of the top shroud 112 by the first and second elastic members 136 and 138 when the top shroud 112 is being placed in the open position as shown in FIG. 6. In addition, the first stop portion 146 is formed on a first molded member 140 located on the top shroud 112 and the second stop portion 148 is formed on a third molded member 144 located on the back panel 116. Referring to FIG. 19, In some embodiments, the first and second stop portions 146 and 148 define respective flat angled contact surfaces that prevent further rotation of the top shroud 112 when top shroud 112 is placed in the open position as the flat angled contact surface of the first stop portion 146 contacts in substantially flush engagement with the flat angled contact surface of the second stop portion 148. This arrangement allows the top shroud 112 to be maintained in a biased open position until an individual forces the top shroud 112 back into the closed position.

In order to place the top shroud 112 in the open position, an individual lifts the top shroud 112 in a direction that exposes the distal opening 130 of the headcover 100 as illustrated by directional arrow 506 (FIG. 6). In the open position, an individual may either insert the golf club 102 through the upper portion 108 of the headcover 100 or retrieve the golf club 102 from the upper portion 108 of the headcover 100 such that the club head 106 never passes through the proximal opening 128 of the headcover 100. As the top shroud 112 is rotated from the closed position to the open position, the top shroud 112 passes an equilibrium point 302 (FIG. 6) that allows the bias applied by the first and second elastic members 136 and 138 to be applied to top shroud 112 in order maintain the top shroud 112 in the open position along axis 304 (FIG. 6) when the first and second stop portions 146 and 148 engage each other and prevent further rotation of the top shroud 112 in the open position.

Conversely, an individual may close the headcover 100 by rotating the top shroud 112 in direction 504 (FIG. 6) that closes off the distal opening 130. When the top shroud 112 rotates back through the equilibrium point 302, the first and second elastic members 136 and 138 bias the top shroud 112 back to the closed position (FIG. 1).

Figure 7:
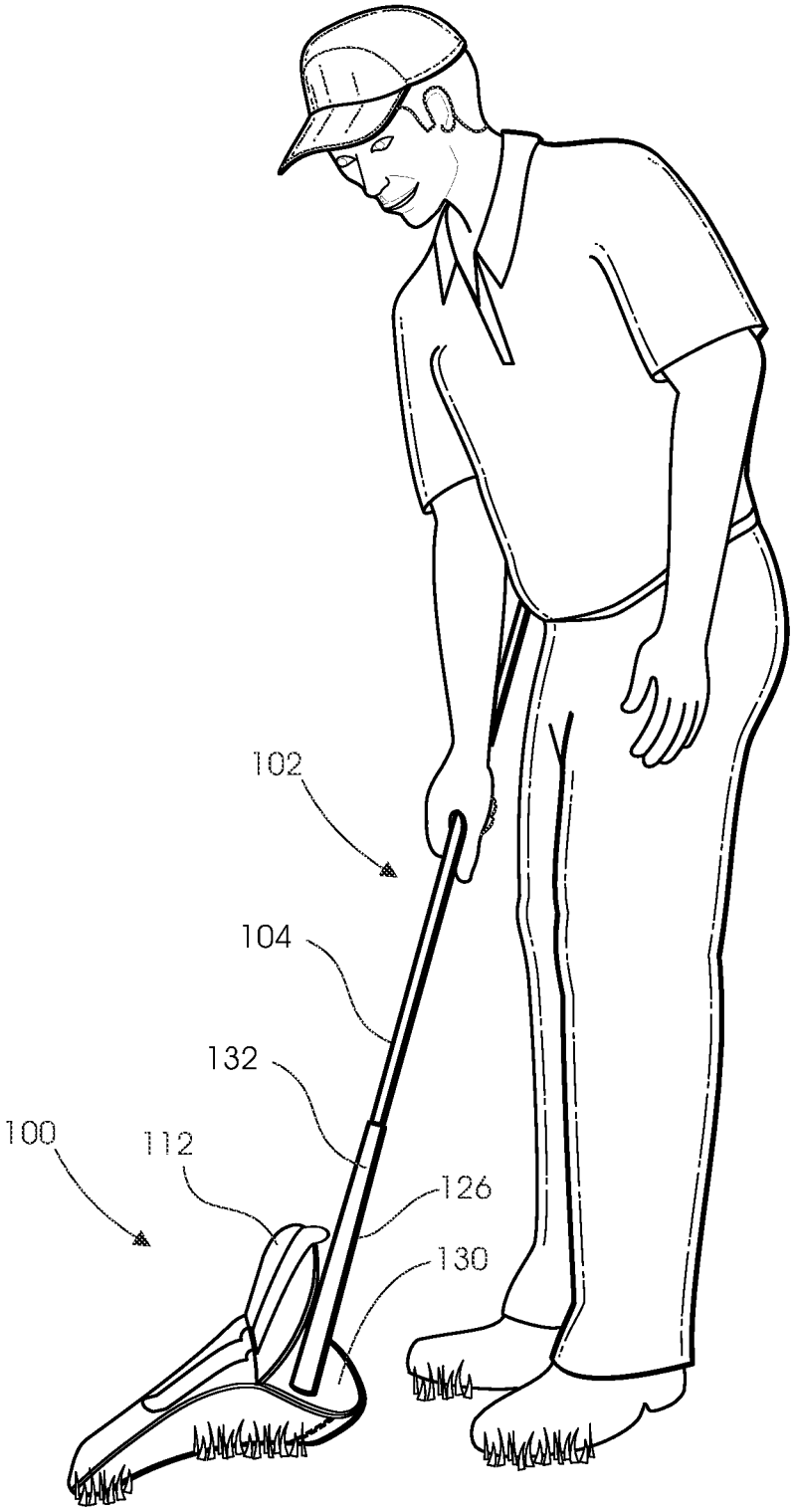
FIGS. 7-10 illustrate one method of using the top loading headcover of FIG. 1 with a golf club.
Figure 8:
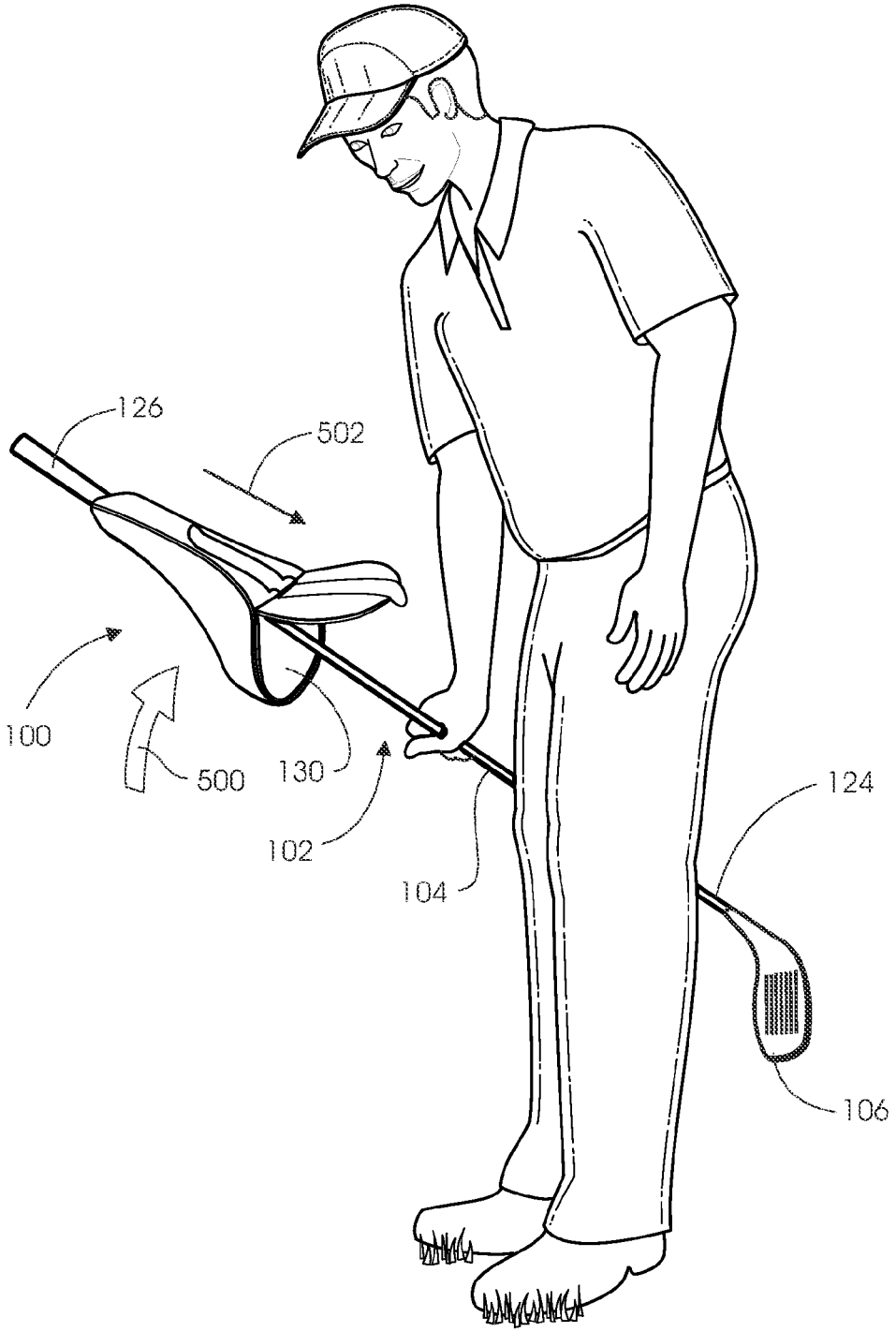
Figure 9:
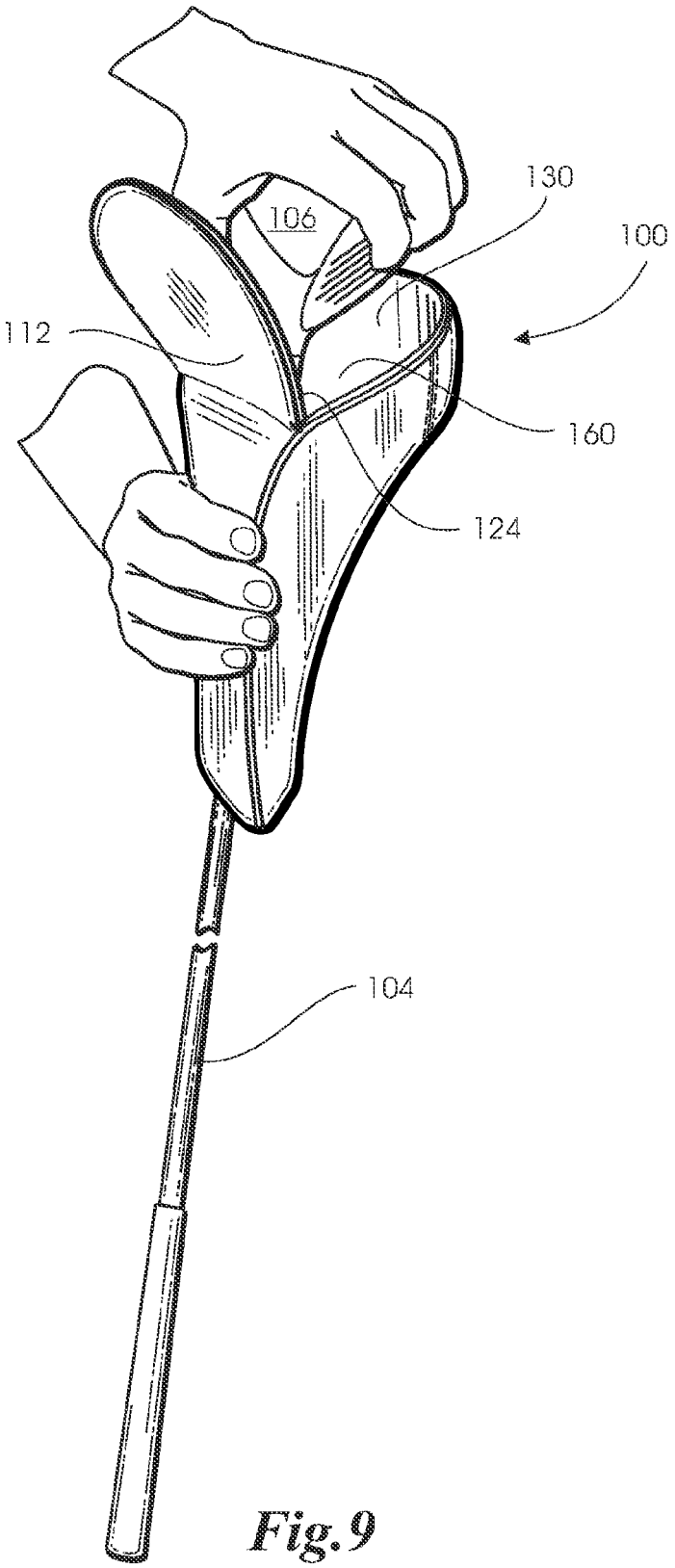
Figure 10:
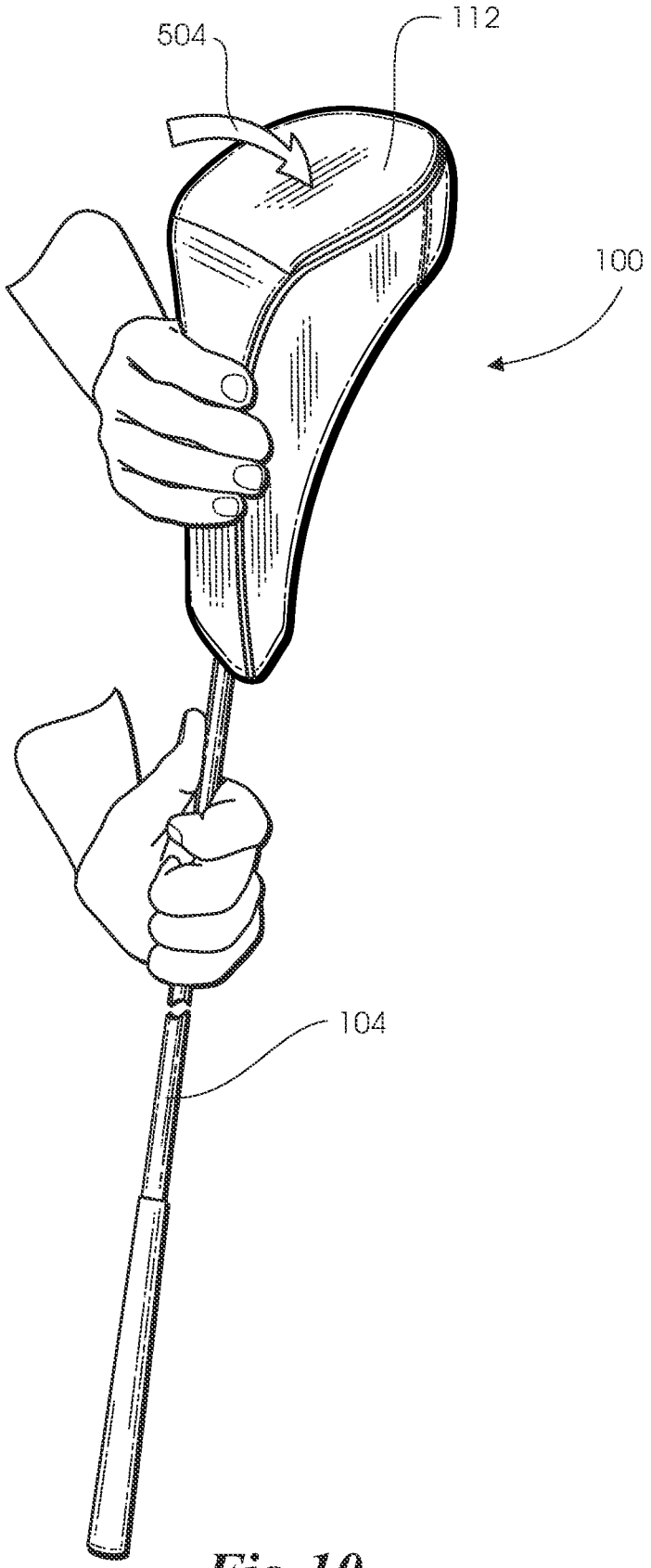

FIGS. 7-10 illustrate a sequence of steps for performing one method of storing the golf club 102 in the headcover 100. As shown in FIG. 7, after removing the golf club 102 from the headcover 100 and using the golf club 102 an individual may insert the proximal end 126 of the club shaft 104 (e.g., the end of the club shaft 104 having the grip 132) through the distal opening 130 of headcover 100 with the top shroud 112 in the open position. This insertion action may be accomplished when the headcover 100 is on the ground such that the individual does not have to substantially lean over and pick up the headcover 100 from the ground in order to store the golf club 102, but may stand substantially upright when performing the steps of the method. Referring to FIG. 8, once the individual inserts the golf club 102 into the distal opening 130, the club shaft 102 may then be oriented in a substantially upward direction 500 relative to the ground such that the headcover 100 slides downward along the club shaft 104 from the distal end 124 of the club shaft 104 towards the proximal end 126 of the club shaft 104 in direction 502 by force of gravity until the headcover 100 reaches the distal end 124 of the club shaft 104 proximate the club head 106. Referring to FIG. 9, once the headcover 100 reaches the distal end 124 of the club shaft 104 the club head 106 can be passed through the distal opening 130 and disposed within the interior portion 160 of the headcover 100. Once the club head 106 is fully disposed within the headcover 100, the individual rotates the top shroud 112 in the closed position as illustrated by direction 504 to close off the distal opening 130 and encase the club head 106 and a portion of the club shaft 104 within interior portion 160 of the headcover 100 as shown in FIG. 10.

Figure 11:
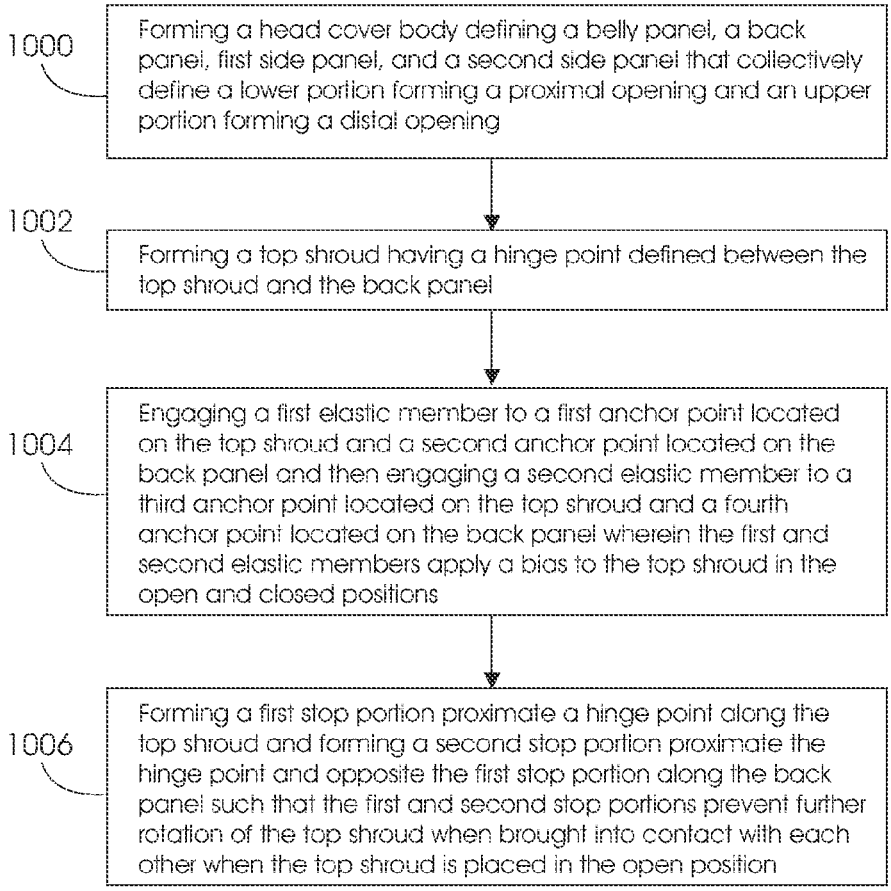
FIG. 11 is a flow chart illustrating one method for manufacturing the top loading headcover of FIG. 1.

Referring to FIG. 11, one method for manufacturing the headcover 100 is illustrated. At block 1000, forming a headcover body 101 defining a belly panel 114, a back panel 116, a first side panel 118 and a second side panel 120 that collectively define a lower portion 110 forming a proximal opening 128 and an upper portion 108 forming a distal opening 130. At block 1002, forming a top shroud 112 having a hinge point 122 defined between the top shroud 112 and the back panel 116. At block 1004, engaging a first elastic member 136 to a first anchor point 152 located on the top shroud 112 and a second anchor point 154 located on the back panel 116 and then engaging a second elastic member 138 to a third anchor point 156 located on the top shroud 112 and a fourth anchor point located on the back panel 116, wherein the first and second elastic members 136 and 138 apply a bias to the top shroud 112 in the open and closed positions. At block 1006, forming a first stop portion 146 proximate the hinge point 122 along the top shroud 112 and then forming a second stop portion 148 proximate the hinge point 122 and opposite the first stop portion 148 along the back panel 116 such that the first and second stop portions 146 and 148 prevent further rotation of the top shroud 112 when brought into contact with each other as the top shroud 112 is being placed in the open position.

While a particular order of actions is illustrated in FIG. 11, these actions may be performed in other temporal sequences. For example, two or more actions depicted in FIG. 11 may be performed sequentially, concurrently, or simultaneously. Alternatively, two or more actions depicted may be performed in reverse order. Further one or more actions in FIG. 11 may not be performed at all. The apparatus, methods, and articles of manufacture described herein are not limited in this regard.

Figure 17:
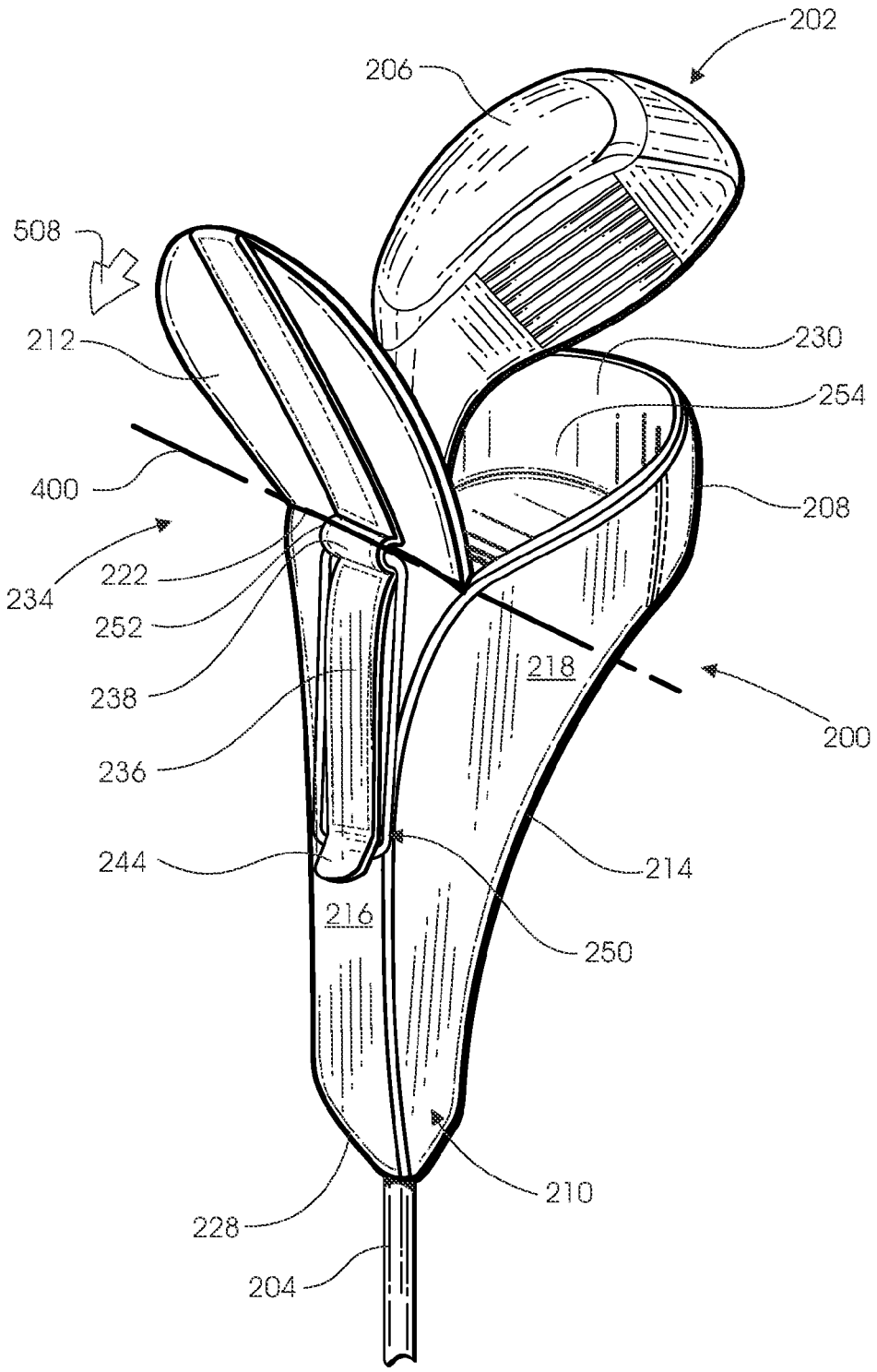
FIG. 17 is a perspective view of the top loading headcover of FIG. 12 shown in the open position.

Referring to FIGS. 12-17, another embodiment of the top loading headcover, designated 200, may include a headcover body 201 having a belly panel 214, a back panel 216, a first side panel 218 and a second side panel 220 that collectively define a lower portion 210 having a proximal opening 228 and collectively define an upper portion 208 having a distal opening 230 (FIG. 17). Referring to FIG. 17, the proximal opening 228 and the distal opening 230 directly communicate with an interior portion 254 formed by the headcover body 201 that is configured to receive therein a golf club 202, and in particular the club head 206 and a portion of the club shaft 204. In addition, a top shroud 212 is connected to the back panel 216 through a hinge point 222 that allows the top shroud 212 to be rotated along an axis 400 between a closed position when the top shroud 212 no longer contacts the upper portion 208 of the headcover body 201, thereby preventing communication with the distal opening 230 and an open position when the top shroud 212 no longer contacts the upper portion 208 of the headcover body 201, thereby allowing communication with the distal opening 230. In some embodiments, the hinge point 222 defines a dividing line between the top shroud 212 and the back panel 216 that is configured to permit rotation of the top shroud 212 relative to the back panel 216 between the open and closed positions.

Referring back to FIGS. 12-16, the headcover 200 further includes a biasing mechanism 234 engaged to the headcover body 201 that securely maintains the top shroud 212 in either a closed position such that communication with the distal opening 230 is prevented or an open position such that communication with the distal opening 230 (FIG. 17) is permitted. In one embodiment, the biasing mechanism 234 includes a webbing strip 236 that extends along the upper portion 208 of the headcover body 201 from top shroud 212 to the back panel 216, while a distal hook portion 242 is defined along the upper portion 208 of the first and second side panels 218 and 220 proximate the distal opening 230. The webbing strip 236 defines a distal hook portion 242 (FIGS. 13 and 15-17) formed proximate the upper portion 208 of the first and second side panels 218 and 220 and a proximal hook portion 244 (FIGS. 12 and 14-17) formed proximate the back panel 216. As shown, the webbing strip 236 collectively forms a channel 238 with the top shroud 212 approximately midway along the length of the webbing strip 236. In addition, the webbing strip 236 may be positioned on the upper portion 208 of the headcover body 201 along the top shroud 212 such that the channel 238 is located proximate the hinge point 216. The apparatus, methods and articles of manufacture are not limited in this regard.

Figure 12:
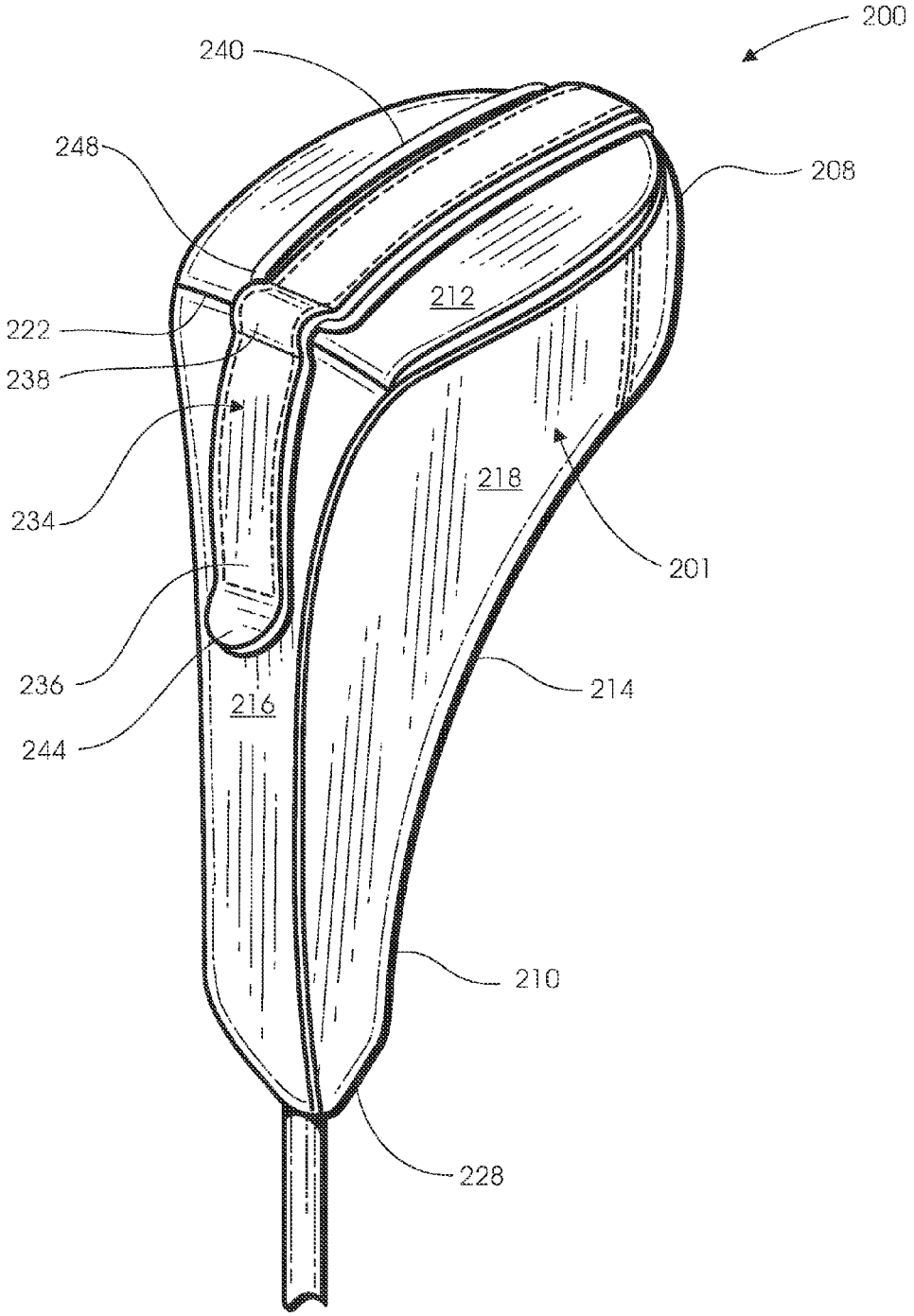
FIG. 12 is a perspective view of a second embodiment of the top loading headcover shown in a closed position.
Figure 13:
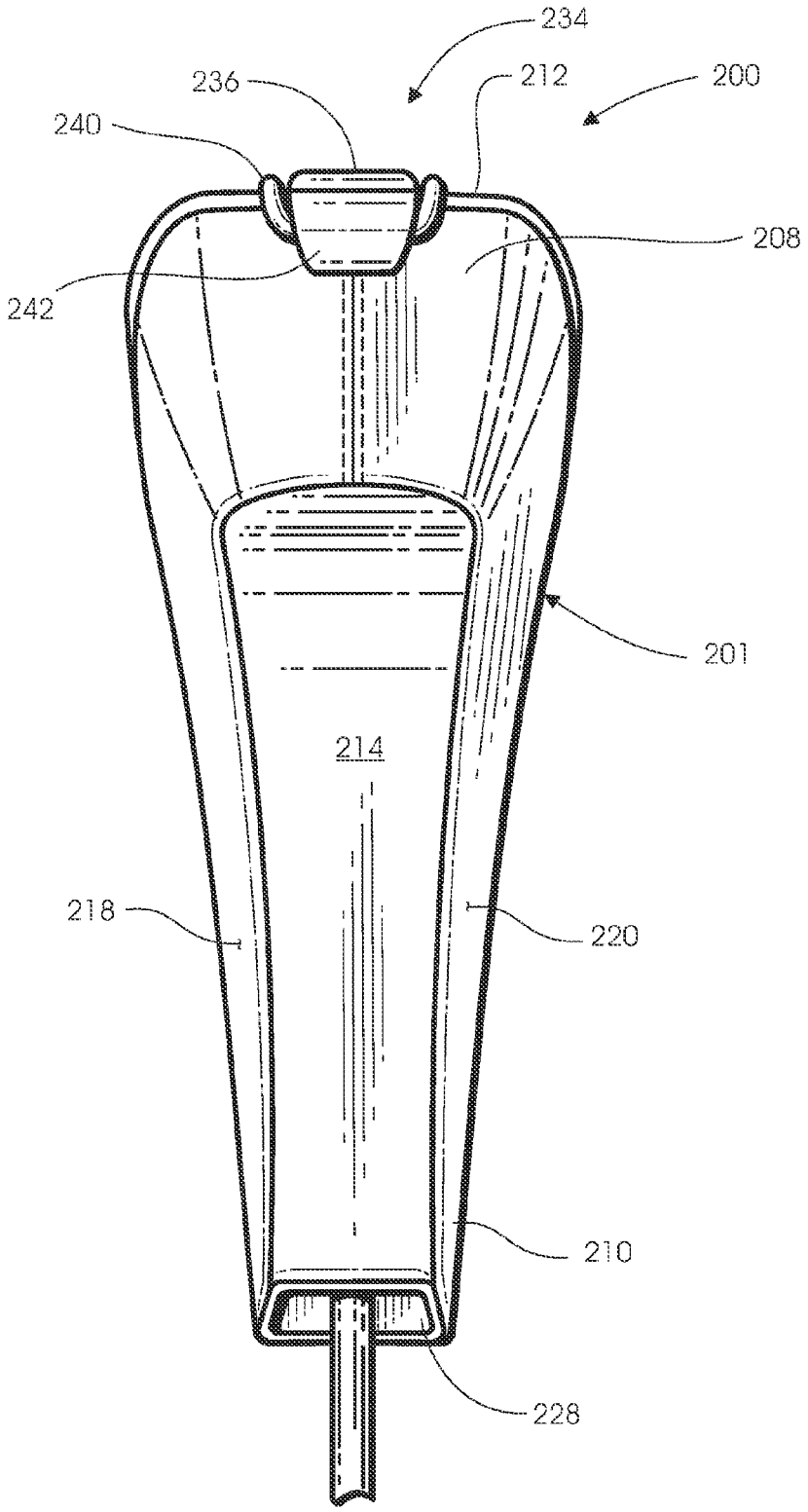
FIG. 13 is a front view of the top loading headcover of FIG. 12.
Figure 14:
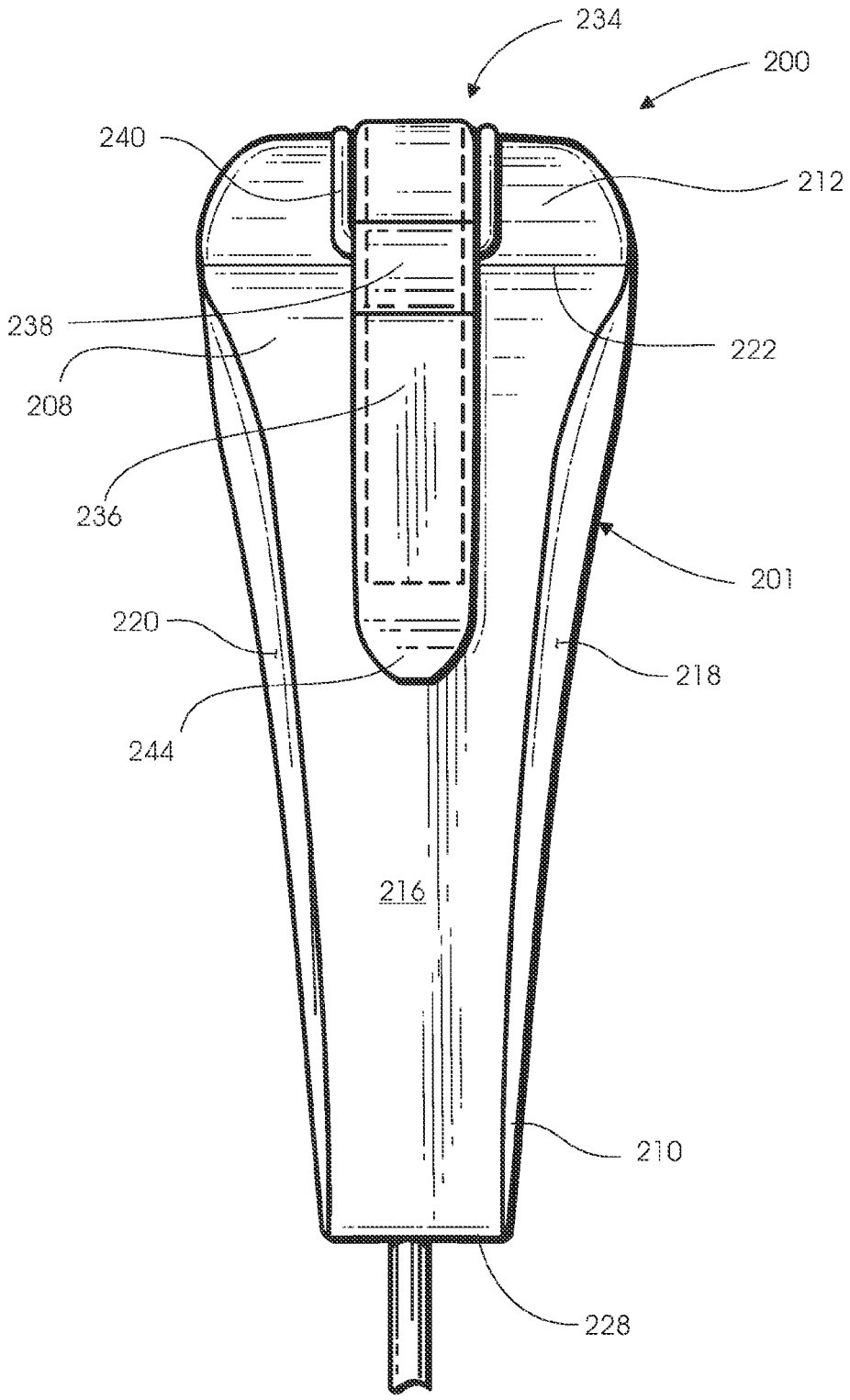
FIG. 14 is a rear view of the top loading headcover of FIG. 12.
Figure 15:
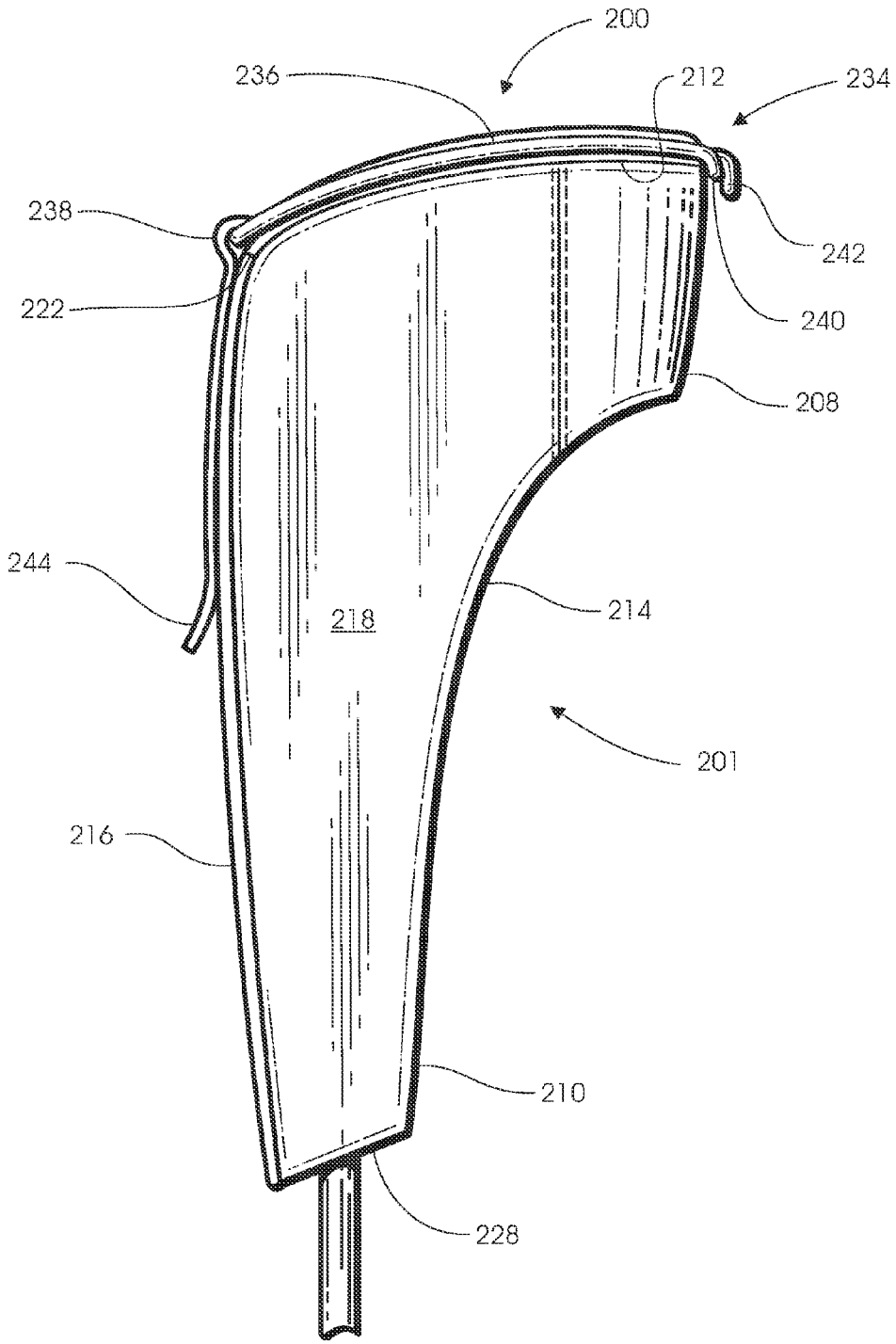
FIG. 15 is a side view of the top loading headcover of FIG. 12.
Figure 16:
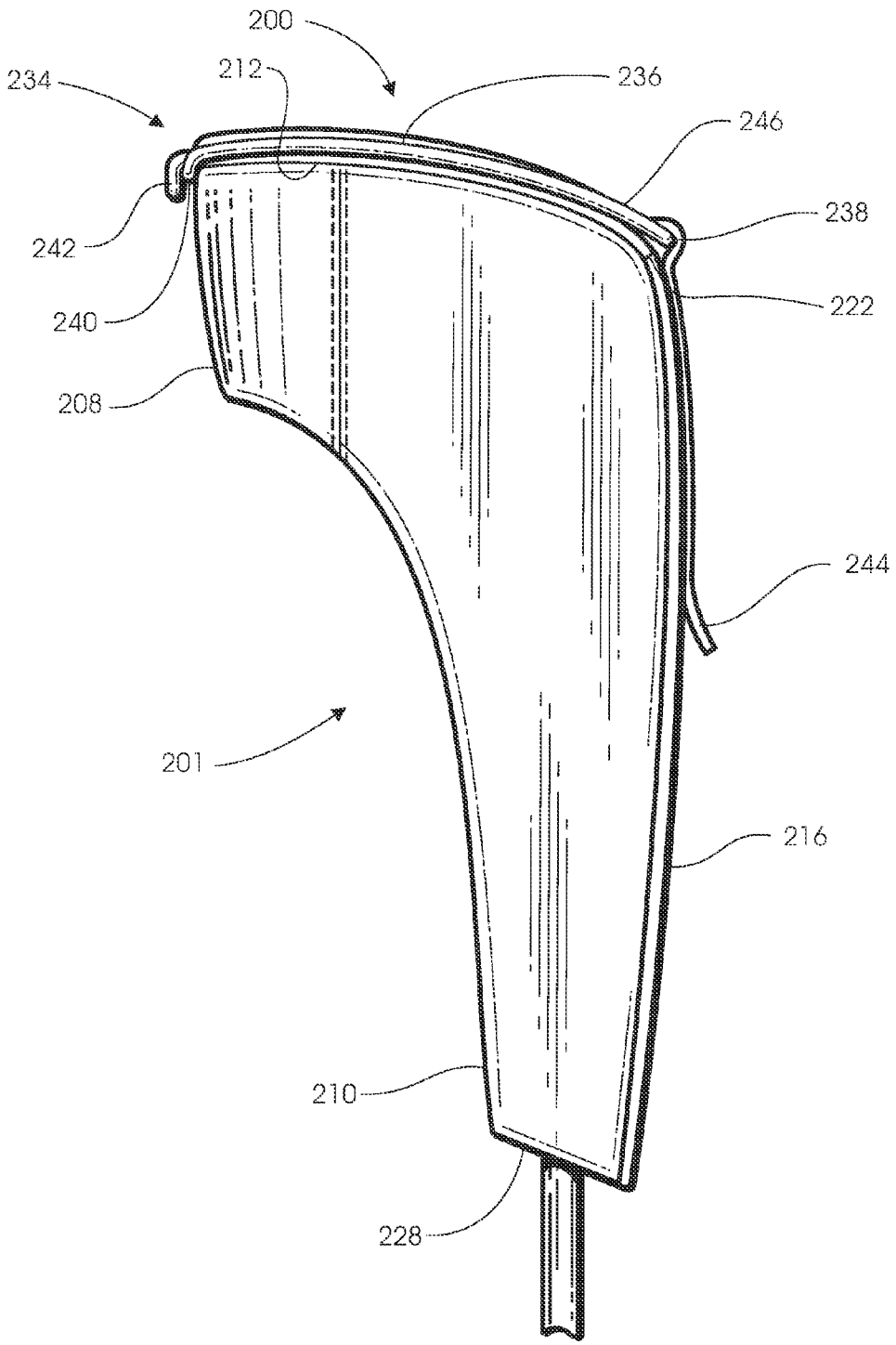
FIG. 16 is an opposite side view of the top loading headcover of FIG. 12.

The biasing mechanism 234 further includes an elastic member 240 forming a loop configuration that is configured to engage the webbing strip 236 to maintain the top shroud 212 in either the closed or open positions. In particular, as shown in FIG. 12, the elastic member 240 is configured to have one portion engaged to the distal hook portion 242 at a first anchor point 246 while another portion of the elastic member 240 is configured to engage the webbing strip 236 along channel 238 at a second anchor point 248 to maintain the top shroud 212 in the closed position. As shown in FIG. 17, the elastic member 240 is also configured to have one portion engaged to the proximal hook portion 244 at a third anchor point 250 while another portion of the elastic member 240 is configured to engage the webbing strip 236 along channel 238 at a fourth anchor point 252. Due to the elasticity of the elastic member 240, the elastic member 240 imparts a spring force that firmly secures the top shroud 212 to the distal opening 230 in the closed position (FIG. 12) or props open the top shroud 212 in the open position (FIG. 17). In operation, placing the top shroud 212 in the open position requires an individual to disengage the elastic member 240 from the distal hook portion 242 (FIG. 12) and engage the elastic member 240 to the proximal hook portion 244 (FIG. 17). This operation secures the top shroud 212 in the open position until the individual disengages the elastic member 240 from the webbing strip 236 and rotates the top shroud 212 back to the closed position. Conversely, placing the top shroud 212 in the closed position requires an individual to disengage the elastic member 240 from the proximal hook portion 244 of the webbing strip 236 and engage the elastic member 240 to the distal hook portion 242 of the webbing strip 236.

In one embodiment, the webbing strip 236 may be secured to the upper portion 208 of the headcover body 201 by a stitching arrangement, although in other embodiments the webbing strip 236 may be integral with the headcover body 201 or attached to the headcover body 201 using an adhesive or other like substance. In some embodiments, the elastic member 240 may be a bungee cord, although other types of elastic members, such as a rubber band, are contemplated that generate a bias when placed in a stretched condition. The apparatus, methods, and articles of manufacture are not limited in this regard.

As shown and described above in FIGS. 7-10 in relation to headcover 100, the headcover 200 may also be used to retrieve and store the golf club 202 in a substantially similar manner as headcover 100. In particular, the headcover 200 may be placed on the floor or ground while an individual is using the golf club 202 and then the individual may retrieve and store the golf club 202 by inserting the proximal end 226 of the club shaft 204 (e.g., the end of the club shaft 204 having the grip 232) through the distal opening 230 and into the interior portion 254 of the headcover 200. Once the individual inserts the golf club 202 through the distal opening 230, the club shaft 204 may be oriented in a substantially upward manner relative to the ground such that the headcover 200 slides downward along the club shaft 204 by force of gravity until the headcover 200 reaches the distal end 224 of the club shaft 204 proximate the club head 206. Once the club head 206 reaches the distal end 224 of the club shaft 204 the club head 206 may be passed through the distal opening 230 and disposed within the interior portion 254 of the headcover 200. Once the club head 206 is fully disposed within the headcover 200, the individual places the top shroud 212 in the closed position and engages the elastic member 240 to the distal hook portion 242 to maintain the top shroud 212 in the closed position. During this operation, the elastic member 240 remains engaged to the channel 238 of the webbing strip 236.

Figure 18:
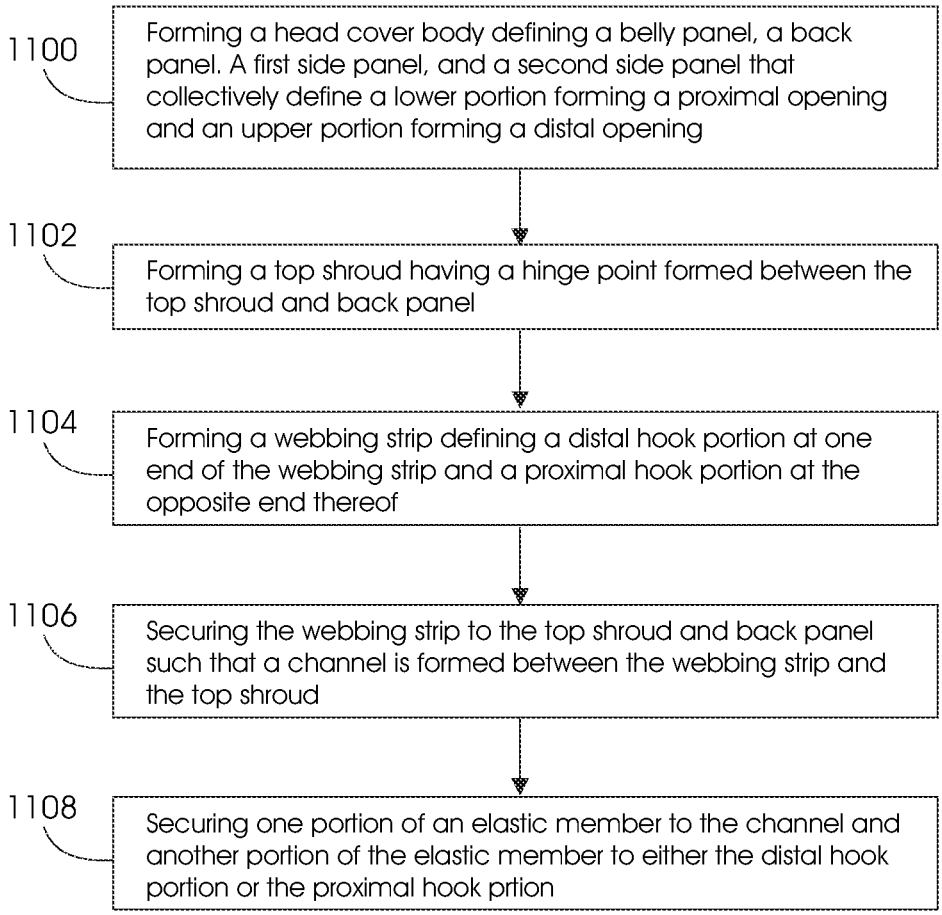
FIG. 18 is a flow chart illustrating a method for manufacturing the top loading headcover of FIG. 12.

Referring to FIG. 18, one method for manufacturing the headcover 200 is illustrated. At block 1100, forming a headcover body 201 defining a belly panel 214, a back panel 216, a first side panel 218 and a second side panel 220 that collectively define a lower portion 210 forming a proximal opening 228 and an upper portion 208 forming a distal opening 230. At block 1102, forming a top shroud 212 having a hinge point 222 formed between the top shroud 212 and the back panel 216. At block 1104, forming a webbing strip 236 defining a distal hook portion 242 at one end of the webbing strip 236 and a proximal hook portion 244 at the opposite end thereof. At block 1106, securing the webbing strip 236 to the top shroud 212 and back panel 216 such that a channel 238 is formed between the webbing strip 236 and the top shroud 212. At block 1108, securing one portion of an elastic member 240 to the channel 238 and another portion of the elastic member 240 to either the distal hook portion 242 or the proximal hook portion 244.

While a particular order of actions is illustrated in FIG. 18, these actions may be performed in other temporal sequences. For example, two or more actions depicted in FIG. 18 may be performed sequentially, concurrently, or simultaneously. Alternatively, two or more actions depicted may be performed in reverse order. Further one or more actions in FIG. 18 may not be performed at all. The apparatus, methods, and articles of manufacture described herein are not limited in this regard.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A headcover comprising:

a headcover body comprising:

a top shroud, a belly panel, a back panel, a first side panel and a second side panel;

a distal opening formed at a top portion defined by the headcover body, wherein the distal opening is in communication with an interior portion defined by the headcover body and configured to receive a golf club therein;

a proximal opening formed at a lower portion defined by the headcover body, wherein the proximal opening is in communication with the interior portion;

a hinge point formed between the top shroud and the back panel, wherein the hinge point is configured to allow the top shroud to rotate relative to the back panel between a closed position to prevent communication with the distal opening and an open position to permit communication with the distal opening;

a first elastic member coupled to the head cover body including a distal end of the first elastic member engaged to the top shroud and a proximal end of the first elastic member engaged to the back panel with the first elastic member extending along the first side panel between the top shroud and the back panel;

a second elastic member coupled to the head cover body including a distal end of the second elastic member engaged to the top shroud and a proximal end of the second elastic member engaged to the back panel with the second elastic member extending along the second side panel between the top shroud and the back panel;

a first stop member defined along the top shroud proximate the hinge point; and a second stop member defined along the back panel proximate the hinge point and in opposite relation to the first stop member, wherein the first stop member is configured to engage the second stop member to maintain the top shroud in the open position.

2. The headcover of claim 1, wherein at least one of the first elastic member and the second elastic member applies a bias to the top shroud to maintain the top shroud in the open position.

3. The headcover of claim 1, wherein the first elastic member and the second elastic member collectively apply a bias to the top shroud to maintain the top shroud in the open position.

4. The headcover of claim 1, wherein the first elastic member and the second elastic member collectively apply a bias to the top shroud to maintain the top shroud in the open position, wherein the engagement of the first stop member with the second stop member prevents further rotation of the top shroud in the open position and counters the bias applied by the first elastic member and the second elastic member to the top shroud.

5. The headcover of claim 1, wherein the headcover further comprises a first molded member defined on the top shroud and a second molded member defined on the back panel, wherein the first molded member forms a first anchor point configured to engage the distal end of the first elastic member and the second molded member forms a second anchor point configured to engage the proximal end of the first elastic member, wherein the first molded member forms a third anchor point configured to engage the distal end of the second elastic member and the second molded member forms a fourth anchor point configured to engage the proximal end of the second elastic member.

6. The headcover of claim 1, wherein the headcover further comprises a first molded member defined on the top shroud and a second molded member and a third molded member defined on the back panel, wherein the first stop member is formed along a portion of the first molded member and the second stop member is formed along a portion of the third molded member, wherein the first stop member and second stop member are configured to contact each other when the top shroud is in the open position to prevent further rotation in the open position.

7. The headcover of claim 1, wherein the first stop member and the second stop member define respective flat angled contact surfaces configured to terminate rotation of the top shroud in the open position when the first stop portion engages the second stop portion.

8. The headcover of claim 1, wherein the first stop member and the second stop member each define respective flat angled contact surfaces configured to terminate the rotation of the top should in the open position when the flat angled contact surface of the first stop portion engages the flat angled contact surface of the second stop portion.

9. The headcover of claim 1, wherein the top shroud rotates from a closed position to an open position, wherein the hinge point is configured to establish an equilibrium point when the top shroud is rotated, wherein application of a first force to the top shroud in a first direction at the equilibrium point biases the top shroud to the closed position and application of a second force to the top shroud in a second opposite direction biases the top shroud to the open position.

10. The head cover of claim 1, wherein the first and second elastic members comprise at least one of an elastic cord, a wire, an elastic synthetic or organic material, or a spring.

11. A headcover comprising:

a headcover body comprising:

a top shroud, a belly panel, a back panel, a first side panel and a second side panel;

a hinge point formed between the top shroud and the back panel, wherein the hinge point is configured to allow the top shroud to rotate relative to the back panel between a closed position and an open position; and at least one elastic member having a distal end engaged to the top shroud and a proximal end engaged to the back panel wherein the at least one elastic member extends along the first side panel between the top shroud and the back panel.

12. The headcover of claim 11, further comprising:

a first stop member defined along the top shroud proximate the hinge point; and a second stop member defined along the back panel proximate the hinge point and in opposite relation to the first stop member, wherein the first stop member is configured to engage the second stop member to maintain the top shroud in the open position.

13. The headcover of claim 12, wherein the first stop portion and the second stop portion define respective flat angled contact surfaces configured to terminate rotation of the top shroud in the open position when the first stop portion engages the second stop portion.

14. The headcover of claim 11, wherein the distal end of the at least one elastic member is engaged to the top shroud at a first anchor point and the proximal end is engaged to the back panel at a second anchor point.

15. The headcover of claim 11, wherein the at least one elastic member maintains a linear configuration when the top shroud is in the open position.

16. A method of manufacturing a headcover comprising:

forming a headcover body comprising:

a top shroud, a belly panel, a back panel, a first side panel and a second side panel;

a distal opening formed at a top portion defined by the headcover body, wherein the distal opening is in communication with an interior portion defined by the headcover body and configured to receive a golf club therein;

a proximal opening formed at a lower portion defined by the headcover body, wherein the proximal opening in is in communication with the interior portion; and a hinge point formed between the top shroud and the back panel, wherein the hinge point is configured to allow the top shroud to rotate relative to the back panel between a closed position to prevent communication with the distal opening and an open position to permit communication with the distal opening;

engaging a respective distal end of a first elastic member and a second elastic member to the top shroud and engaging a respective proximal end of the first elastic member and the second elastic member to the back panel, wherein the first elastic member extends along the first side panel between the top shroud and the back panel and the second elastic member extends along the second side panel between the top shroud and the back panel;

forming a first stop member along the top should proximate the hinge point; and forming a second stop member along the back panel proximate the hinge point and in opposite relation to the first stop member, wherein the first stop member is configured to engage the second stop member to maintain the top shroud in the open position.

17. The method of claim 16, wherein forming the first stop member further includes forming a first flat angled contact surface and forming the second stop member includes forming a second flat angled contact surface configured to contact the first flat angled contact surface to maintain the top shroud in the open position.

* * * * *